US006211840B1

(12) United States Patent
Wood et al.

(10) Patent No.: US 6,211,840 B1
(45) Date of Patent: Apr. 3, 2001

(54) CROSSED-DROOPING BENT DIPOLE ANTENNA

(75) Inventors: Peter John Wood, Nepean; Peter C. Strickland, Ottawa; Senglee Foo, Gloucester; Timothy Edward Best, Elgin, all of (CA)

(73) Assignee: EMS Technologies Canada, Ltd., Ottawa (CA)

( * ) Notice: Subject to any disclaimer, the term of this patent is extended or adjusted under 35 U.S.C. 154(b) by 0 days.

(21) Appl. No.: 09/174,001

(22) Filed: Oct. 16, 1998

(51) Int. Cl.[7] ..... H01Q 9/16

(52) U.S. Cl. ..... 343/793; 343/797; 343/795

(58) Field of Search ..... 343/821, 793, 343/794, 795, 700 MS, 810, 796, 803, 804, 797, 798; H01Q 9/16

(56) References Cited

U.S. PATENT DOCUMENTS

| | | | | |
|---|---|---|---|---|
| 2,480,153 | | 8/1949 | Masters | 250/33.53 |
| 2,480,154 | | 8/1949 | Masters | 250/33 |
| 2,973,517 | | 2/1961 | Watts | 343/795 |
| 3,025,524 | | 3/1962 | Thies | 343/823 |
| 3,039,095 | | 6/1962 | Josephson | 343/708 |
| 3,114,913 | | 12/1963 | Alford | 343/795 |
| 3,369,245 | | 2/1968 | Rea | 343/795 |
| 3,641,578 | | 2/1972 | Spanos . | |
| 3,765,023 | * | 10/1973 | Ben-Dov | 343/797 |
| 3,771,162 | | 11/1973 | Dienes . | |
| 3,815,141 | | 6/1974 | Kigler | 343/795 |
| 3,943,522 | * | 3/1976 | Ben-Dov | 343/797 |
| 4,686,536 | * | 8/1987 | Allcock | 343/700 MS |
| 4,825,220 | | 4/1989 | Edward . | |
| 5,170,176 | * | 12/1992 | Yasunaga et al. | 343/895 |
| 5,173,715 | | 12/1992 | Rodal . | |
| 5,754,145 | * | 5/1998 | Evans | 343/795 |
| 5,796,372 | * | 8/1998 | Elliot | 343/797 |

OTHER PUBLICATIONS

"Resonant Quadrafilar Helix" by C.C, Kilgus, IEEE Transactions A–17 May 19, 1969, pp. 249–351.

"A Quadrafilar Helical Antenna For Low Elevation GPS Applications", S. Foo, Microwave Journal, Jan. 1998, pp. 179–184.

"Antenna Engineering Handbook" (2nd edition), by Richard C. Johnson and Henry Jasik, pp. 13–19 to 13–20.

"Radscan a Novel Conically Scanning Tracking Feed", by Arthur Sullivan, Electro Magnetic Process, Inc., pp. 247–256.

* cited by examiner

*Primary Examiner*—Don Wong
*Assistant Examiner*—Shih-Chao Chen
(74) *Attorney, Agent, or Firm*—Pascal & Associates

(57) ABSTRACT

An antenna comprising at least one dipole, the dipole comprising a pair of arms drooping relative to a plane orthogonal to a central axis, end portions of the arms being bent back toward the central axis. In one form of the invention the arms are bent back toward the central axis in at least one plane which is parallel to the central axis, and in another form of the invention the dipole arms are bent in the same rotational direction out of a pland which includes the central axis.

18 Claims, 6 Drawing Sheets

CROSSED-DROOPING BENT DIPOLE ANTENNA

FIELD OF THE INVENTION

This invention relates to the field of antennae and in particular to a low profile improved crossed bent dipole antenna which can be used to achieve a wide beam as an isolated element or in a phased array at microwave frequencies.

BACKGROUND TO THE INVENTION

In communications antenna applications, there is sometimes a need to generate an antenna beam which can be scanned electronically to cover a very wide range of pointing angles, the required coverage spanning each of two dimensions. An example is the antenna which forms part of an aircraft electronic system which communicates back to earth via a satellite. The beam of the aircraft antenna must be pointed in the direction of the satellite. However, according to the latitude and longitude location of the aircraft, the line of sight to the satellite may lie at low elevation, that is, very near to the horizon. Alternatively, it may lie directly overhead of the aircraft. Yet again, it may lie at some point between these two extremes. In addition, relative to the aircraft, the azimuth bearing of the satellite may be any angle within a 360° range, according to the position of the satellite, and also according to the heading of the path along which the aircraft is flying. Put simply, the aircraft antenna needs to provide for an angular coverage which is specified by an area above the aircraft which covers almost a hemisphere.

In general, the angular position of an antenna beam may be changed either by physically tilting the antenna structure, or by scanning the beam electronically. In the latter case, the antenna structure does not move, and the antenna is designated as being a phase array. This latter device is configured as a number of discrete, small antenna elements. Ordinarily, each of these elements 1 is connected to an electronic phase-shifter device 3 which are coupled to a power splitter 5 to which an input signal is applied, as shown in FIG. 1. There exists a variant which is useful in some particular circumstances, in which several discrete elements are connected to another, forming a subarray. In this variant, a single electronic phase-shifter is used to excite each subarray. The phased array approach is preferred for use on an aircraft because a stationary antenna can have a low profile with minimal protrusions on the outside of the aircraft, and the design has a high reliability since there are no moving parts.

For electronic beam scanning, one requirement is that the design must incorporate appropriate electronic phase shifters, and their electronic control circuits. However, for large angular coverage, and in particular for the hemisphere aircraft communication application, there is another important requirement. This requirement is that each of the discrete radiating elements which is used in the design should, when excited as an antenna in its own right, generate a very wide antenna beam which has an almost constant pattern level over the scan range that is ultimately intended for the array. Thus, to meet the aircraft communication requirement, a single element should radiate at fairly constant level at any point on a hemisphere.

The requirement for the single element may be restated in more precise terms. Given that one principal end application involves a phased array, what is important is the immersed element pattern of the element. The immersed element pattern is the pattern which results when a single element is excited by a signal source, but the remaining elements of the array are nevertheless present in a physical sense. When predicting or measuring the immersed element pattern, none of these surrounding elements are connected to the signal source at any particular instant in time, but each of their terminals do connect to an individual matched load. It is the immersed element pattern as defined in this way which should have the desired broad-beam characteristic over almost a hemisphere.

The requirements for a single element of the phased array antenna which communicates with a satellite that uses circular polarization are that (a) The element should be of a circularly polarized type.

(b) The element should be of a very low profile in order that the aerodynamic properties of the aircraft fuselage are not unfavourably impacted (in practice, the phased array elements are accommodated under a radome which is mounted on the outside of the aircraft). The height of this radome is dictated essentially by the height of the elements. For example, it is preferred that an element height should not exceed 8 cm. at the Inmarsat L-band communication frequencies (1525 to 1660 MHZ).

(c) The element should provide "near-hemisphere" coverage characteristics, as discussed above.

It is quite difficult to satisfy all of the above requirements. Of the antenna types that have been described in the published literature, two appeared initially to be promising: a configuration based on drooping dipoles, and the quadrifilar helix as described in C. C. Kilgus, "Resonant Quadrifilar Helix", IEEE Trans. AP-17, May 1969, pp 349–351, and in S. Foo, "A Quadrifilar Helical Antenna For Low Elevation GPS Applications", Microwave Journal, January 1998, pp. 179–184. The quadrifilar helix generates circularly polarized signals, and can be designed so as to give the required wide beam coverage. However its height (about 15 cm for a typical design at L-band) is too great in the aircraft application. Furthermore, for the quadrifilar helix design, the excitation signals would be applied via four coaxial cables which run up the center axis of the element. It would be awkward to provide an interface for this type of feed arrangement, given that the feed circuitry and electronic phase shifters should preferably be incorporated in a strip line device lying just below the elements.

A class of resonant quadrifilar helix antenna called a volute is described in the text "Antenna Engineering Handbook" (second edition), by Richard C. Johnson and Henry Jasik, pp. 13–19 to 13–20. The antenna consist of two orthogonal fractional-turn bifilar helices excited in phase quadrature. This type of antenna is capable of radiating a signal with circular polarization in a cardiod shape pattern. The antenna can be used to provide the wide beamwidth required in the above-described phased array application, over a relatively narrow frequency range.

As noted in the above text, the half-turn, half-wavelength volute is of particular interest because the input impedance of each bifilar can be matched to a 50 ohm coaxial input by minor adjustments of the helical arm lengths without the need of a transformer.

However, such antennae have been very expensive to manufacture. For microwave frequencies, and in particular for airborne or spaceborne applications, the half-wave volute elements are too large, especially when a large number are to be disposed in a phased array.

A solution to the cost problem was described in U.S. Pat. No. 4,686,536 issued Aug. 11, 1987, by David Allcock, and assigned to Canadian Marconi Company. This patent describes conventional drooping crossed dipole elements as described in the aforenoted text, and as on pp. 28-7 ff. thereof. The radiating elements are disposed on printed circuit boards as described in "Radscan A Novel Conically Scanning Tracking Feed", by Arthur Sullivan, Electro Magnetic Processes, Inc, pp. 247–256. However, the radiating elements and the feeds are disposed as microstrip elements on orthogonally arranged printed circuit boards. Unfortunately, the process of interfacing the two planar microstrip circuit boards and tuning the sensitive feed line between the boards is complex, and therefore is costly in production. As shown in FIG. 2, a balun 7 above a ground plane 8 is used to match the dipole elements 9 to a single feeder line 11 which is also spaced from the ground plane 8.

We have discovered that the low angle axial ratio and gain of the antenna described in the above-noted patent is not optimal. It is also clear that the feeder lines to the dipole elements are not balanced.

SUMMARY OF THE INVENTION

The present invention provides a dipole antenna which has low profile elements, provides a substantially improved low angle axial ratio and gain, and provides a balanced feeder which can be matched to the impedance of the antenna elements. Such improved dipole antennae can thus be used in a low profile linear array carried on an aircraft, which can be scanned ±90° along the array axis and 360° in azimuth. Alternatively the element may be used alone to provide near hemisphere coverage with a relatively uniform gain.

In accordance with an embodiment of the invention, an antenna comprises at least one dipole, the dipole comprising a pair of arms drooping relative to a plane orthogonal to a central axis, the end portions of the arms being bent back toward the central axis.

In accordance with another embodiment, for each dipole, a pair of feed lines are disposed parallel to each other and to the central axis, the feed lines being coupled to the dipole arms at ends thereof which are closest to the central axis.

Preferably the feed lines have graded widths so as to match an impedance of the associated dipole at one end and the impedance of the feed points at another end.

In a preferred embodiment of the invention, two similar dipoles are arranged symmetrically and orthogonal to each other.

In accordance with another embodiment, each monopole element and a corresponding feed line of each respective dipole are disposed on one side of an insulating substrate, and another monopole element of the same dipole and a corresponding feed line, for each respective dipole are disposed on the other side of the insulating substrate, the dipoles being mutually located such that each monopole is separated from another by at least the thickness of an insulating substrate.

In accordance with still another embodiment, the dipole elements are bent in the same rotational direction out the plane of the central axis to form a volute antenna.

BRIEF DESCRIPTION OF THE DRAWINGS

A better understanding of the invention will be obtained by a consideration of the detailed description below, in conjunction with the following drawings, in which.

DETAILED DESCRIPTION OF EMBODIMENTS OF THE INVENTION

Figure 1:
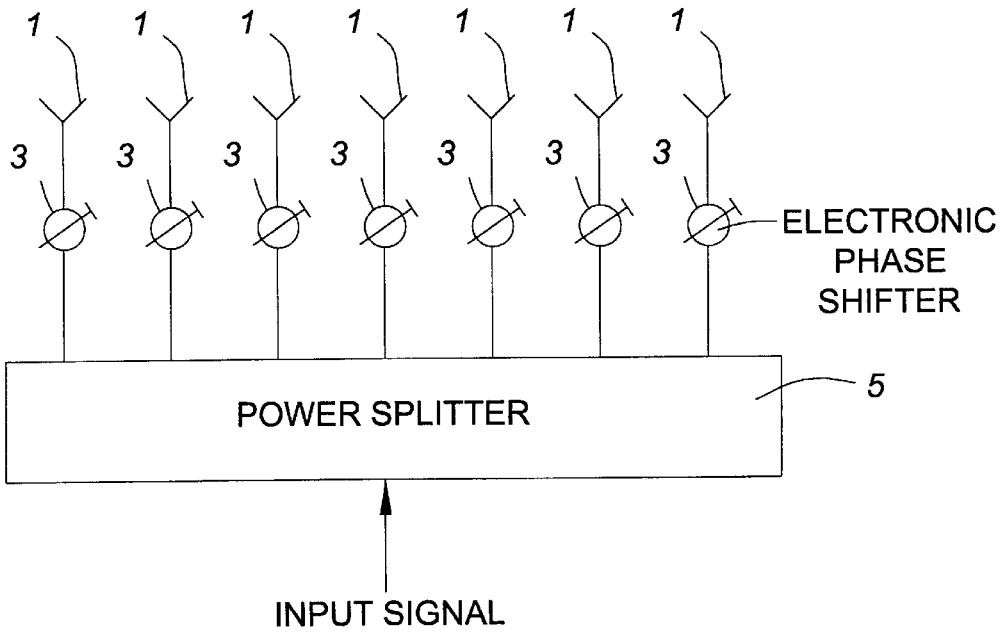
PRIOR ART FIG. 1
FIG. 1 is a block diagram of a phased antenna array.
Figure 3:
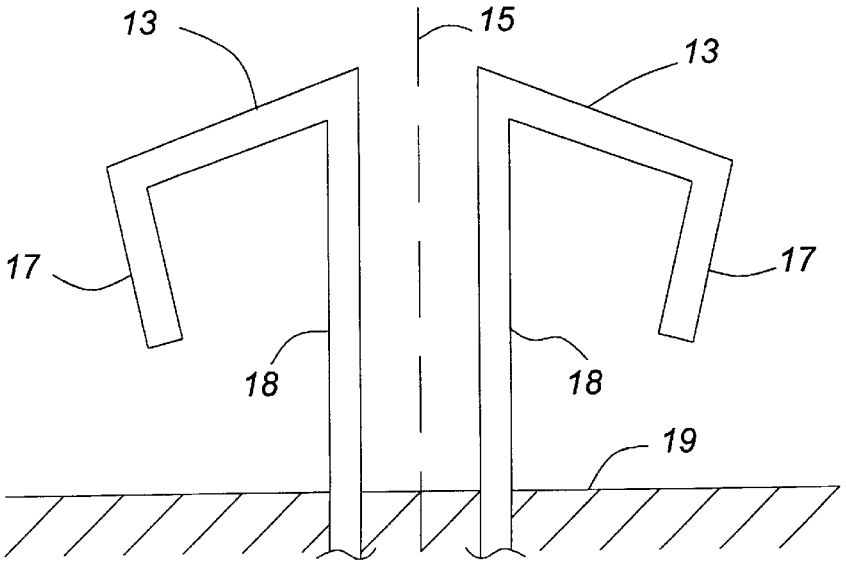
FIG. 3 is a side view of a dipole element that can be used alone or in crossed configuration, and which can be used in a phased array or single element configuration in accordance with an embodiment of the present invention.
Figure 2:
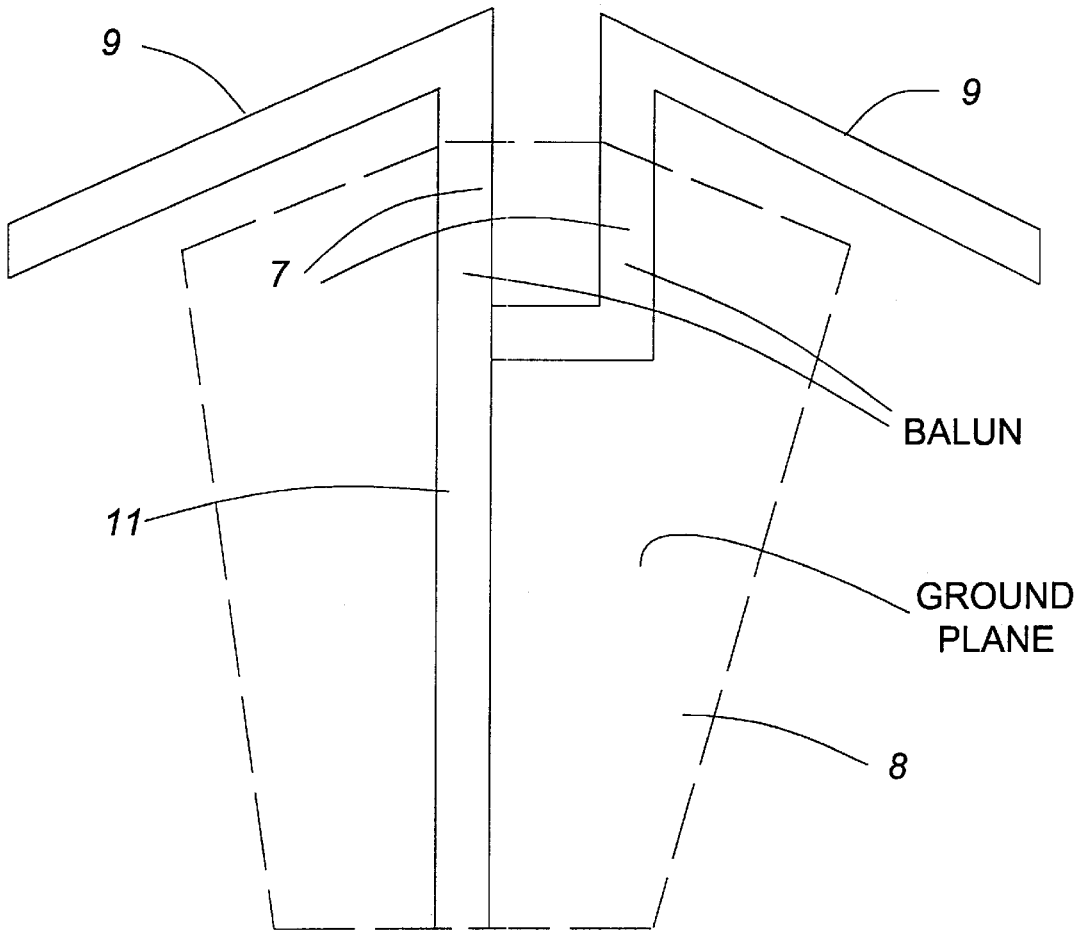
PRIOR ART FIG. 2
FIG. 2 is a side view of a dipole element for a phased array in accordance with the prior art.

Turning to FIG. 3, the dipole element in accordance with an embodiment of the invention is formed with arms which droop from a central axis 15, end portions 17 of the arms being bent preferably inwardly toward the axis 15. For example, the arms 13 can droop 30° relative to a plane which is orthogonal to axis 15, and the arm portions 17 can be bent downwardly so as to be parallel with the axis 15 or inwardly a fraction of the drooping angle relative to the axis 15. The total length of each monopole 13+17 is typically slightly over, but can be approximately ¼ wavelength in length. The particular angles and arms lengths used will depend on the wavelength to be transmitted or received, the gain and the axial ratio desired over a desired hemisphere, and the height of the arms above the ground plane.

The monopoles are fed at their closest ends by balanced parallel feeder lines 18 which will be described in more detail below. The antenna element, formed of two crossed dipoles, extend above a ground plane 19.

The antenna element may be described as a crossed pair of "bent dipoles". Thus each dipole has arms which have been bent in the manner described above, and one of these dipoles has arms which are in a plane which is orthogonal to those of the other dipole. To excite circular polarization, the two dipoles of a complete element are fed with signals which have equal amplitudes, but with phases which differ by 90°. The element design is such as to radiate over a large flat ground plane. In the actual application, the major part of this ground plane is typically provided by the aircraft fuselage. The ground plane has the effect of ensuring that the radiated signal levels are low outside of the hemispherical coverage zone.

To radiate the circularly polarized signal over a hemisphere angular coverage, the element must radiate via electric currents on its structure which flow in all three principal directions in three dimensional space (i.e., the Cartesian directions x, y and z for example). With the element oriented as shown in FIG. 3, with its ground plane horizontal, this is the configuration when the aircraft is in level flight. Then, the top part 13 of the bent dipoles support currents which flow in two orthogonal, nearly horizontal directions. The outer parts 17 support near vertical currents. Each top section radiates in a fashion which, to a degree at least, is omni-directional. However, its pattern has nulls (features where the radiation pattern drops to a very low level) in a direction along the relevant top section arms 13. Likewise, the outer sections 17 radiate efficiently in many directions, but their pattern also has a null in a direction along their particular arms, that is, in a nearly vertical direction.

In practice, the overall radiation pattern of the crossed bent dipole antenna can be considered as kind of superposition of the constituent patterns of individual radiating arms, as described above. The currents in any individual arm of the device can be related in magnitude and phase to the currents in the other arms. The relationship is in fact a fairly complex one, in as much as it depends upon all of the geometrical parameters of the structure. These latter parameters include the height of arms above the ground plane, the lengths of the inner and outer dipole arms, and the angles of droop of these inner and outer arms. There is also a dependency on the width of the arms. Nevertheless, by selection of all these parameters, a near-approximation to the ideal goal of an immersed element pattern which provides coverage at uniform amplitude level over an angular range corresponding to almost a hemisphere can be achieved. The optimal values of the parameters can be determined by setting up a mathematical model of the antenna, using Method of Moments simulation software.

Figure 4:
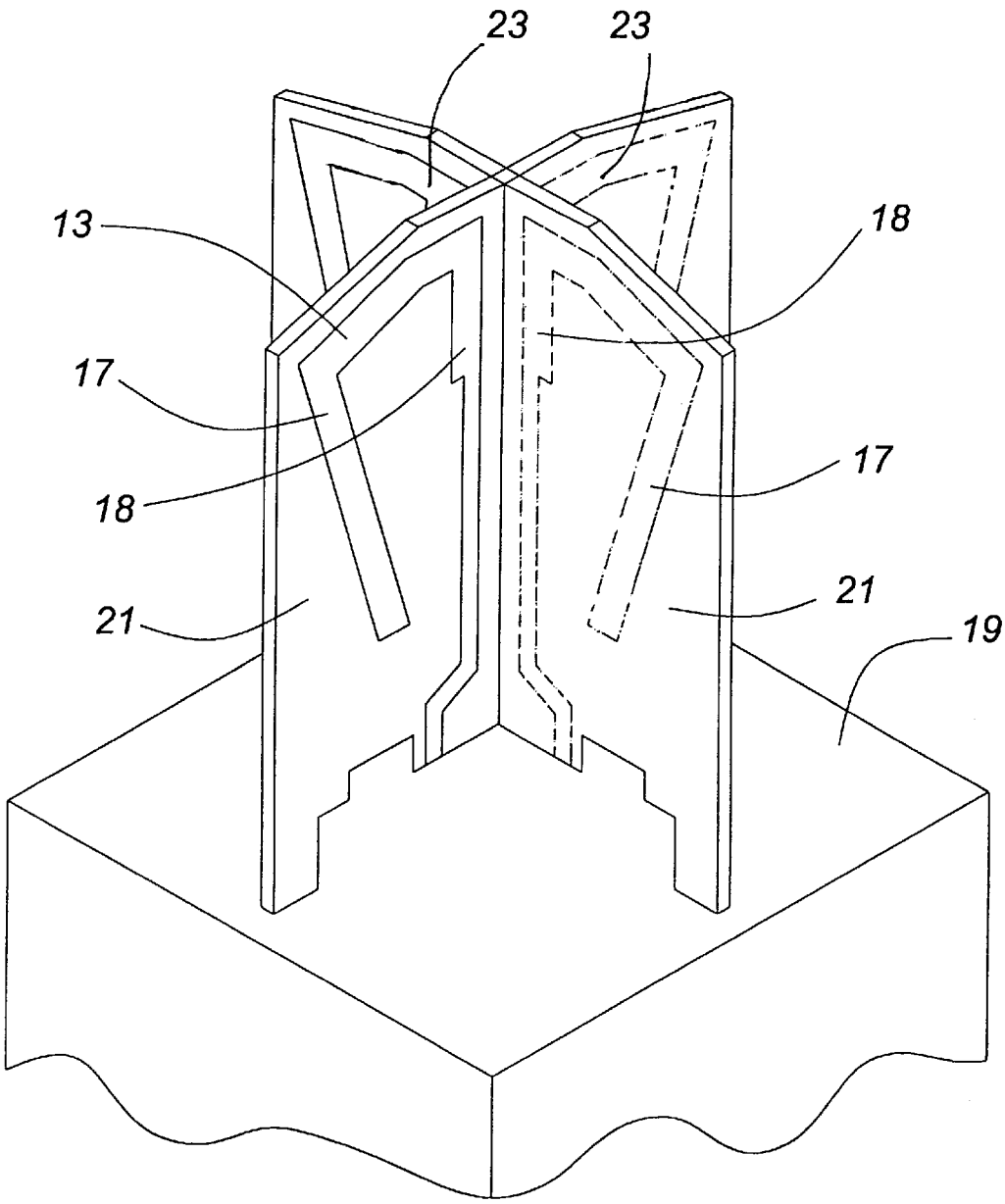
FIG. 4 is an isometric view of a pair of crossed dipole elements in accordance with an embodiment of the present invention.

FIG. 4 illustrates an isometric view of a preferred embodiment of the invention with one dipole shown in phantom. The crossed bent dipole radiating structure is realized as etched copper tracks on a substrate, fabricated using regular printed board technology. Two substrate boards 21 are used to support the two orthogonal dipole units, these boards being positioned at right angles to one another. The primary ground plane is at the bottom of the unit. It is preferably formed by the top copper cladding of a strip line circuit (not shown) which implements the electronic phase shifters (as explained previously, beyond the edges of this copper cladding, the aircraft fuselage functions as an extension to this primary ground plane).

Figure 5:
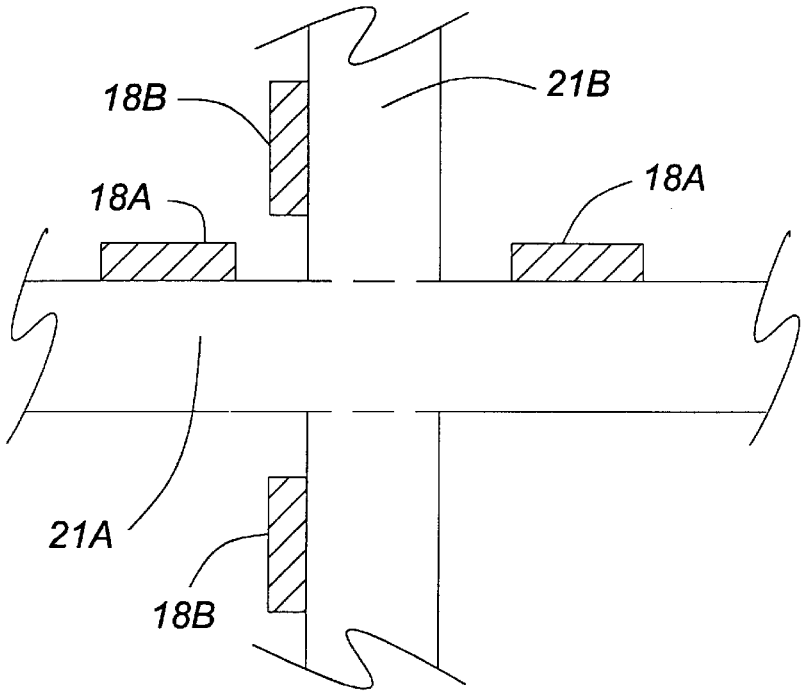
PRIOR ART FIG. 5
FIG. 5 is a cross-section of substrates which carry feeder lines for a pair of crossed dipole elements in accordance with the prior art.

The dipole feed points are positioned at the top, center part 23 of the dipole element. When the antenna is receiving, the signals pass from these feed points to the base of the unit by balanced, two conductor transmission lines 18 (when the antenna is transmitting to the satellite, the direction of propagation along the transmission lines is reversed). Each balanced line consists of two copper strips running parallel to each other. Conventionally, such a balanced line would be constructed with two copper strips running along the same side of the support substrate, as shown in FIG. 5.

It may be seen that both pairs of tracks 18A and 18B are respectively on the same side of the substrates 21A and 21B. Therefore one pair of tracks 18A and 18B are located closer to each other than the other pair of tracks. The balance is therefore disturbed.

Figure 6:
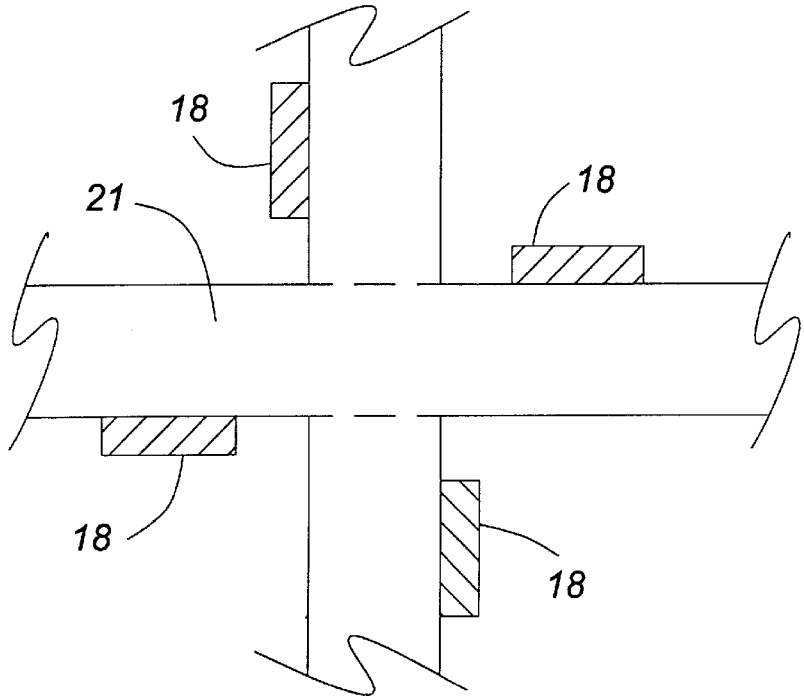
FIG. 6 is a cross-section of substrates which carry feeder lines for a pair of crossed dipole elements in accordance with an embodiment of the present invention.

FIG. 6 illustrates a cross-section of the crossed substrates in accordance with an embodiment of this invention. The two strips 18 for each dipole are etched on opposing sides of the dielectric substrate 21, along with the corresponding dipole arms.

The balanced line feeders form a very efficient transmission system, having much lower losses than a coaxial cable. The "opposing sides" configuration is more symmetrical than the "same sides" version for a crossed substrate application, and results in radiation patterns which have improved symmetry. The "opposing sides" structure also results in four feed points which are configured in a symmetrical fashion. With this symmetrical feed arrangement, it is straight forward and easier to connect the radiating elements directly to strip-line power splitter circuits at the base of the unit.

In common with many other types of radiating element, the input impedance of a crossed bent dipole element does not inherently match a standard value, such as 50 ohms resistive. A matching structure is added in order to synthesize the standard impedance values. The required matching is obtained by stepping the width of the balanced lines at intervals along their length as may be seen in FIG. 4.

To summarize, the element in accordance with embodiments of the present invention realizes the following properties:

a) By virtue of the special "crossed bent dipole" radiating geometry as shown in FIG. 3:
   (i) Radiation of circularly-polarized signals with a good axial ratio.
   (ii) An immersed element pattern which gives effective coverage over almost a hemisphere of signal directions.
   (iii) "Low profile" dimensions with an overall height of about 8 cm, at L band communication frequencies.

b) By virtue of the feed line matching sections built into the balanced lines as shown in FIG. 4:
   (i) Good input impedance properties.

c) By virtue of the "opposing sides" configuration of the substrate tracks, as shown in FIG. 6:
   (i) Very symmetrical electrical performance with little variation for different scan planes. Symmetry is further enhanced because there are four drive points per element, so that in effect the excitation of each dipole arm, comprising one half of a bent dipole, may be controlled via a power splitter which lies beneath the elements.
   (ii) A very simple and inexpensive mechanical construction. Essentially, the element is fabricated as two etched circuit boards. At one end of the element there are four drive point tracks (FIG. 6), and these are configured so as to allow a direct connection (via a solder joint) with the microstrip power splitter board which is located under the elements.

d) A very light-weight design. As for the simple mechanical construction, the weight becomes an important issue when many elements are used in an array.

Figure 7:
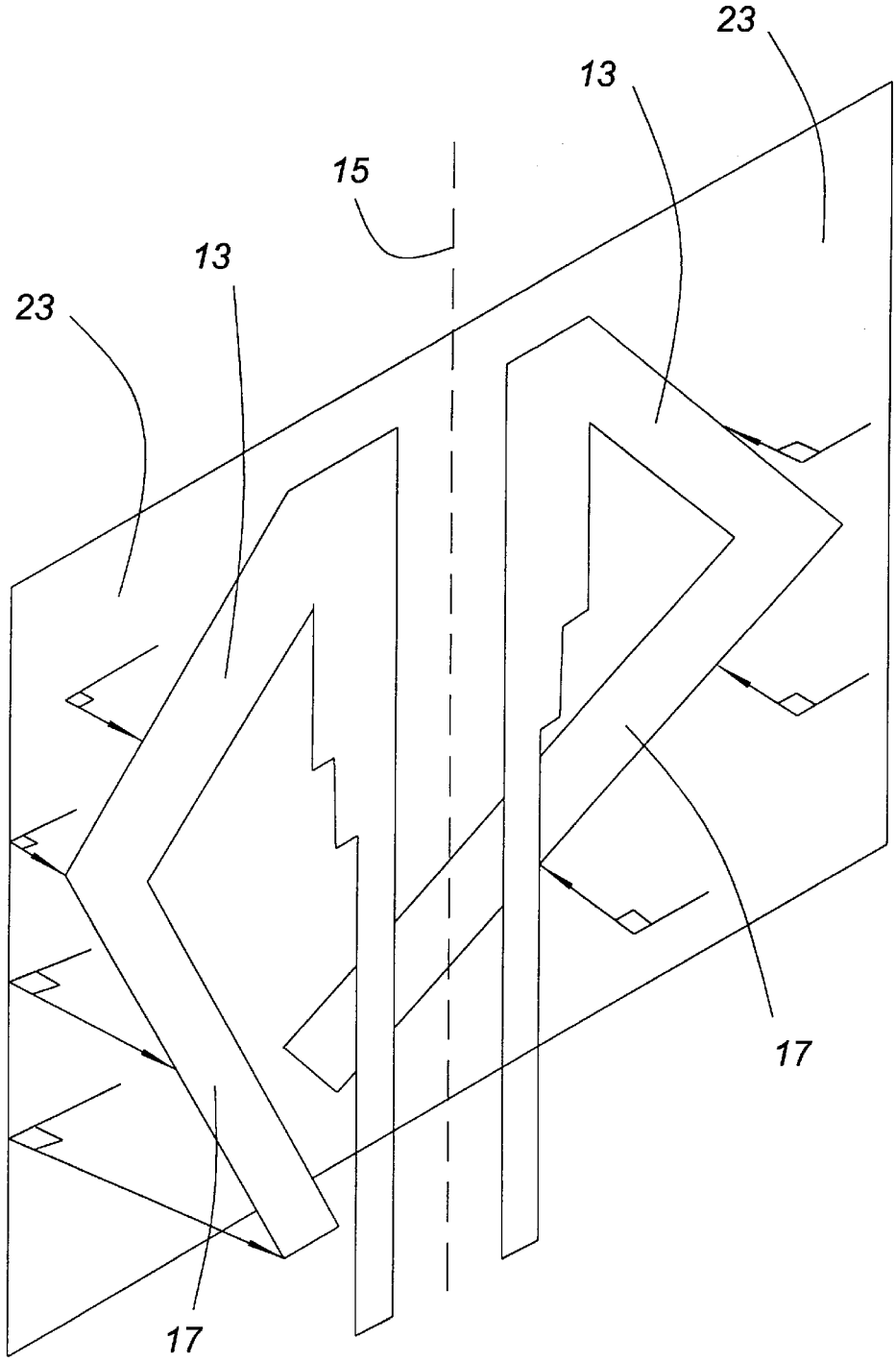
FIG. 7 is an isometric view of another embodiment of the invention in which the antenna elements form a volute antenna.

In accordance with another embodiment of the invention, the arms of the dipoles are bent out of planes which are parallel to the axis 15, in the same rotational direction. This is shown in isometric view in FIG. 7 forming volute elements, wherein the arrows illustrate a distance of the arms from the adjacent hypothetical planes 23 which are parallel to the central axis 15.

The radiating arms can be formed as part of an injection molded plastic structure, although other techniques for manufacture may be used, as will be described later. Currents on the arms produce the radiated field. The bend of the arms out of the plane of the feed is integral to the performance of the volute elements, increasing gain and improving axial ratio at low elevation angles.

This embodiment of the invention has a complex curvature and cannot be fabricated according to the existing art using two rigid interlaced planar circuit boards. Instead, the element is preferably produced by injection moulding of a plastic which is selectively metallized using any of a variety of techniques potentially including any of the following:

metallization using electroless plating, flame spraying, vapour deposition or other processes followed by selective etching of the metal, by use of an ultraviolet photosensitive polymer etch resist or other method, embedding of a metal foil into the plastic, adding a metallized tape to the surface of the plastic moulding, adding a separate curved wire soldered to the metallized plastic moulding.

The element operates differently from conventional designs such as the drooping crossed dipole. In the drooping crossed dipole, the currents on the radiating arms are constrained to flow in straight paths constrained to the two crossed planes, whereas in the volute design described herein the currents on the active radiating arms flow along compound curves not constrained to two orthogonal planes. The use of arms curved within the planes and/or sloped out of the planes of the feed creates a radically different radiating structure which has improved gain and axial ratio at low elevating angles.

The feed lines can be as described with reference to the previous embodiment, and achieves the desired symmetry of operation and ease of connectivity.

Figure 8:
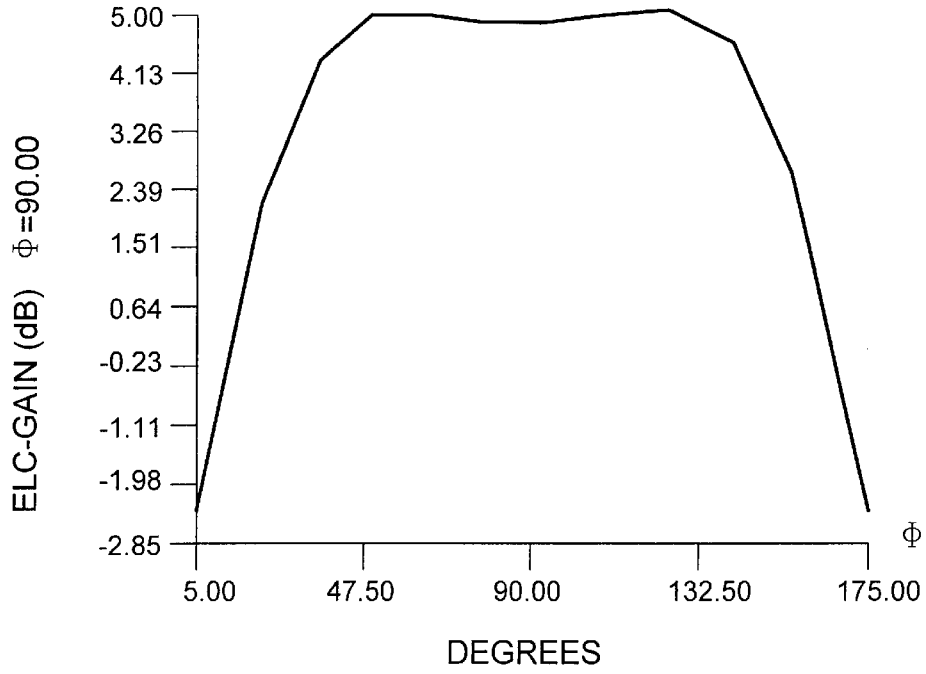
FIG. 8 is an elevation pattern achieved with the embodiment of FIG. 7.

In a successful embodiment, the height of the feed lines and antenna was about 70 mm. An elevation pattern as shown in FIG. 8 was achieved. This demonstrated a gain of approximately 2 dBic at 15 degrees elevation at 1.5 GHz over a virtually infinite ground plane.

Figure 9:
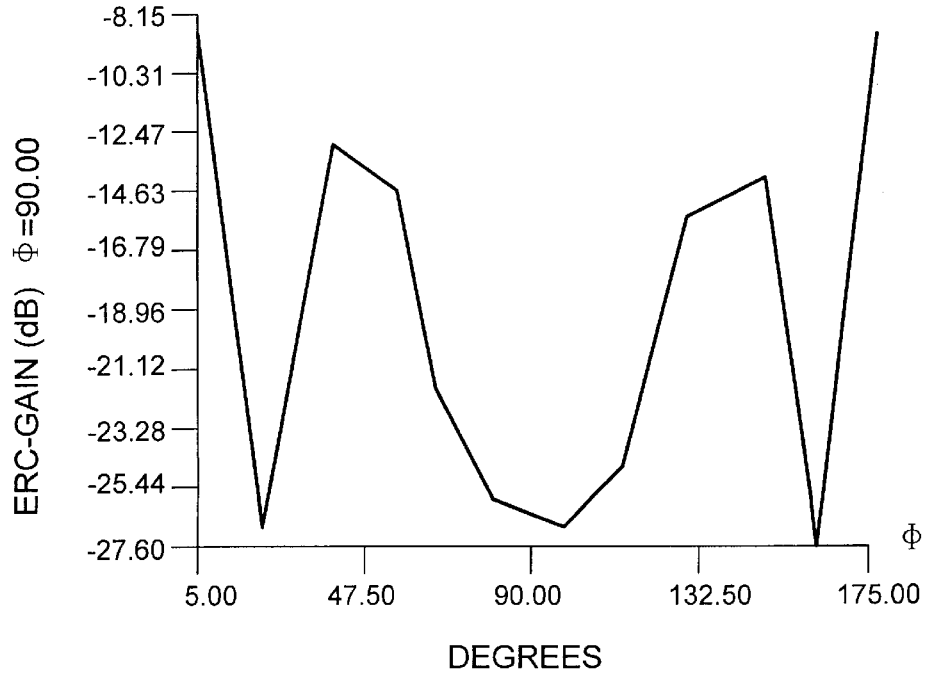
FIG. 9 is a cross-polarization pattern as a function of elevation, achieved with the embodiment of FIG. 7.

FIG. 9 illustrates the typical cross-polarization of the element as a function of elevation, with a value of below −20 dBic at 15 degrees above the horizon.

In normal operation the four feed lines of the embodiments of the antennae described herein are excited with near equal amplitudes and relative phases near 0, 90, 180 and 270 degrees. In the phased array environment, mutual coupling will typically require excitations which deviate slightly from this in order to achieve optimum performance.

A person understanding this invention may now conceive of alternate embodiments and enhancements using the principles described herein. All such embodiments and enhancements are considered to be within the spirit and scope of this invention as defined in the claims appended hereto.

What is claimed is:

1. An antenna comprising at least one dipole element, each dipole element comprising a pair of arms with each arm comprising two connected portions, a first portion drooping relative to a plane orthogonal to a central axis and a second portion being bent back toward the central axis wherein the second portion is connected to the first portion at a first end of the first portion.

2. The antenna as defined in claim 1 in which the second portions of the arms are coplanar with the central axis.

3. The antenna as defined in claim 1, including for each dipole element, a pair of feed line which are parallel to each other and to the central axis, each feed line being coupled to an arm at a second end of the first portion, said second end being closer to the central axis than the first end.

4. The antenna as defined in claim 3 in which the feed lines have graded widths so as to match the impedance of the associated dipole element at one end of the feed lines and the impedance of feed points at another end.

5. The antenna as defined in claim 1 including two dipole elements being arranged symmetrically and orthogonal to each other.

6. The antenna as defined in claim 3 including two dipole elements arranged symmetrically and orthogonal to each other.

7. The antenna as defined in claim 6 in which for each dipole element, a first monopole element and a feed line corresponding to the first monopole element are disposed on one side of an insulating substrate and on one side of the central axis, and a second monopole element of the same dipole element and a feed line corresponding to the second monopole element are disposed on the other side of the insulating substrate and on the other side of the central axis, the dipole elements being mutually located such that each monopole element is separated from another monopole element by at least the thickness of an insulating substrate.

8. The antenna as defined in claim 7 in which the substrates are formed of insulating dielectric planar supports which are interleaved at 90° to each other.

9. The antenna as defined in claim 8 in which the substrates are printed circuit boards.

10. The antenna as defined in claim 7 in which the feed lines have graded widths so as to match the impedance of the associated dipole element at one end of the feeds lines and the impedance of feed points at another end.

11. The antenna as defined in claim 7 in which the dipole elements and the feed lines are formed of at least one of (a) at least one metal layer embedded in an injection moulded plastic substrate, (b) at least one selectively metallized moulded plastic substrate, and (c) at least one selectively etched metallic layer adherent to an injection moulded plastic substrate.

12. The antenna as defined in claim 10 in which the dipole elements and the feed lines are formed of at least one of (a) at least one metal layer embedded in an injection moulded plastic substrate, (b) at least one selectively metallized moulded plastic substrate, and (c) at least one selectively etched metallic layer adherent to an injection moulded plastic substrate.

13. The antenna as defined in claim 5 in which the second portions of the arms of each dipole elements are bent in the same rotational direction out of a plane which includes the central axis and the first portions of the arms.

14. The antenna as defined in claim 7 in which the second portions of the arms of each dipole element are bent in the same rotational direction out of a plane which includes the central axis and the first portions of the arms.

15. The antenna as defined in claim 14 in which the dipole elements are formed of metallized layers on opposite sides of an insulating substrate.

16. The antenna as defined in claim 15 in which the insulating substrate is formed of moulded plastic.

17. The antenna as defined in claim 14 in which the dipole elements and feed lines are formed of at least one of (a) at least one metal layer embedded in an injection moulded plastic substrate, (b) at least one selectively metallized moulded plastic substrate, and (c) at least one selectively etched metallic layer adherent to an injection moulded plastic substrate.

18. The antenna as defined in claim 1 in which for each arm, the central axis pierces a plane defined by the first portion and the second portion of that arm.

* * * * *